United States Patent [19]

Bürcher

[11] Patent Number: 4,598,739

[45] Date of Patent: Jul. 8, 1986

[54] STRIP-WOUND HOSE

[76] Inventor: Friedrich Bürcher, Freischützstr. 17,, 8000 München 81, Fed. Rep. of Germany

[21] Appl. No.: 731,746

[22] Filed: May 7, 1985

Related U.S. Application Data

[63] Continuation of Ser. No. 460,291, Jan. 24, 1983, abandoned.

[30] Foreign Application Priority Data

Jan. 27, 1982 [DE] Fed. Rep. of Germany ..... 3202516
Feb. 8, 1982 [DE] Fed. Rep. of Germany ..... 3204244

[51] Int. Cl.[4] ..... F16L 11/16
[52] U.S. Cl. ..... 138/135; 138/154
[58] Field of Search ..... 138/129, 134, 135, 154

[56] References Cited

U.S. PATENT DOCUMENTS

| | | | |
|---|---|---|---|
| 1,284,064 | 11/1918 | DeLano | 138/156 |
| 1,512,802 | 10/1924 | Robertson et al. | 138/154 |
| 1,598,872 | 9/1926 | Palmer | 138/135 |
| 2,417,676 | 3/1947 | Chernaek | 138/135 |
| 2,841,183 | 7/1958 | Rejeski | 138/135 |

*Primary Examiner*—James E. Bryant, III
*Attorney, Agent, or Firm*—Robert K. Youtie

[57] ABSTRACT

For joining together the turns of strip-wound hose and edges of the strip forming the turns are overlapped and folded connection band is placed along such folds. The connection band is then squeezed forming a fold neck in which the edges of the strip or strips are locked. Furthermore the connection band may be bent into an S-cross section with two open bays or pockets into which the overlapping strip edges are tucked before the pressing to give a strong seam. The edge parts of the strip may have a bead or be turned over.

4 Claims, 3 Drawing Figures

STRIP-WOUND HOSE

This is a continuation of application Ser. No. 460,291, filed Jan. 24, 1983, now abandoned.

The present invention is with respect to strip-wound hose made of metal foil and to a process and apparatus for making such hose.

One of the main uses of hose of this sort, that is mostly manufactured from synthetic resin strip and has a cross section area of 50 to 100 sq. cm., is permanent installation in buildings, machinery or vehicles as air, fume or exhaust ducting. Such hose has to have a number of special properties. More specially it has to be low in price, that is to say be simply and readily produced, but on the other hand it has to have a certain tensile strength and a certain degree of flexibility so that it may be used without elbow fittings. In many cases the hose has to be non-combustible or hardly combustible. Furthermore the hose has to be light in weight and readily installed.

To make the hose non-combustible or resistant to burning it may be made of metal and as an example of this aluminum flat ducting has been produced using aluminum sheet that is folded into the form of a rectangular tube having a folded join running along it. However such a stiff pipe or duct is generally of less value than hose inasfar as it is only supplied in given lengths, there is some trouble with transporting it, it may only be installed using special tools and with much manpower and furthermore it is necessary to keep a wide-ranging stock of different sorts of duct parts such as lengths of the duct itself, elbows, unions and the like for round and square duct.

Furthermore more or less flexible aluminum tubes have been produced (as for example Rigoform tubing) made of strip wound corrugated material with the corrugations running in the length direction of the wound strip and overlapping at the edges thereof or having interlocking beads at the lines of contact (see for example U.S. Pat. No. 3,753,367 to Brinkman and the German Offenlegungsschrift specification No. 2,127,750 in the name of Westerbarkey), such interlocking beads or the like keeping the turns of the hose joined together. The corrugations may be stretched out or forced together to a certain degree so that the hose may be placed along bends. However, even so, the tube is still somewhat stiff and if it is greatly over-stretched at the outer part of a bend the joins between the turns of the tube, that in any case are not very strong, are likely to be broken open.

One purpose or object of the present invention is that of designing a form of hose that at one and the same time is flexible, readily transported from place to place and readily installed, while at the same time being made of a form of material that is non-combustible or generally fireproof.

For effecting this purpose and further purposes that will become clear in the present specification, in the invention a strip-wound hose is made up of a metal foil strip in helical turns and a metal connection band, each foil strip turn having an edge portion overlapping with an edge portion of a next adjacent foil strip turn, and additionally overlapping the connection band, wherein the connection band is S-like in transverse section forming 2 pockets facing in opposite directions, the edge portions being tucked from opposite sides into pockets of the connection band with the connection band pressed together to crimp the pockets closed and firmly secure the edge portions, together with an edge tape of U-like cross section placed on an edge portion, which together with the edging tape is taken up in one of the pockets.

In keeping with a further development of the invention such a strip-wound hose is characterized in that a hose is manufactured by supplying a foil strip and connection band with a pocket of the connection band receiving one edge of the strip, supplying the edging tape and forming the same about the other strip edge, and subsequently forming the connection band about the edging tape. As that edge zone of the strip opposite to the connection band is fitted with edging tape before the helical turning, resulting in the strip being coiled along a helical line by turning without any danger of the strip edge becoming free, torn or frayed, even with material that is relatively readily torn such as pure aluminum foil is possible, using a continuous process, for long lengths of hose to be produced, although the length thereof is limited inasfar as in a simple process the hose issuing from the hose producing apparatus is turned; while it is true that it would be possible for a hose to be produced without turning it by having a turning hose shaping head, such an apparatus design would then be over-complex because of the supply of the strip of the connection band and the edging tape from their separate supply reels to the turning shaping head. One specially important property of the hose of the invention is that in the manufacturing process the hose is, generally speaking, not stretched and furthermore there are not residual tensile forces in the material, seeing that foils with only low resistance to tearing may be used as well. That is to say, the supply rate of the material has to be fully in step with the processing thereof. Continuously producing pieces of hose with a length, say of up to ten meters, is possible. Longer pieces are hardly needed because of troubles in installing them, but they would be able to be produced by changing the design of the apparatus in necessary respects, more specially by the addition of a pulling rope joined with the head of the turning hose by a bearing so that the rope would not be twisted by the hose. If necessary it will furthermore be possible for the edge zone, on which the connection strip has been fitted, to be fitted with an edging tape as well.

As part of a further development of the invention, the surface of the connection band and/or of the edging tape is made rough in zones which are to be placed against the material of the strip. This further development of the strip makes it possible for the material of one turn and the next one thereto to be better fixed in relation to each other.

If smooth strip is used for making the hose turns a heavy pressing force is needed on the seven-fold layers, but this may be undertaken at separate points, that is to say with a spacing in the round-the-hose direction and with a force that is greater than in the parts between the pressing points. Because of this pressing operation the material is joined together almost as strongly as in the case of pressure welding.

The hose of the present invention is more specially of value if of aluminum, in the case of which during manufacturing as far as possible no tensile forces are to be produced in the material in view of its low resistance to tearing. Further materials that may be used are steel foil, brass foil and copper foil, that may be used for making hose that is completely non-combustible, and also coated metal foil. The cross section of the hose, that is at first round, may be customized, for example so as to have a rectangular cross section to give a flat duct, or to give a connection fitting that is round at one end and rectangular at the other. Bending the material into the desired form may be done with only a small force and in some cases may even be done on a building site.

Further details, useful effects and developments of the invention will be seen from the claims and the account now to be given of a preferred working example thereof.

Figures 1, 2, 3:
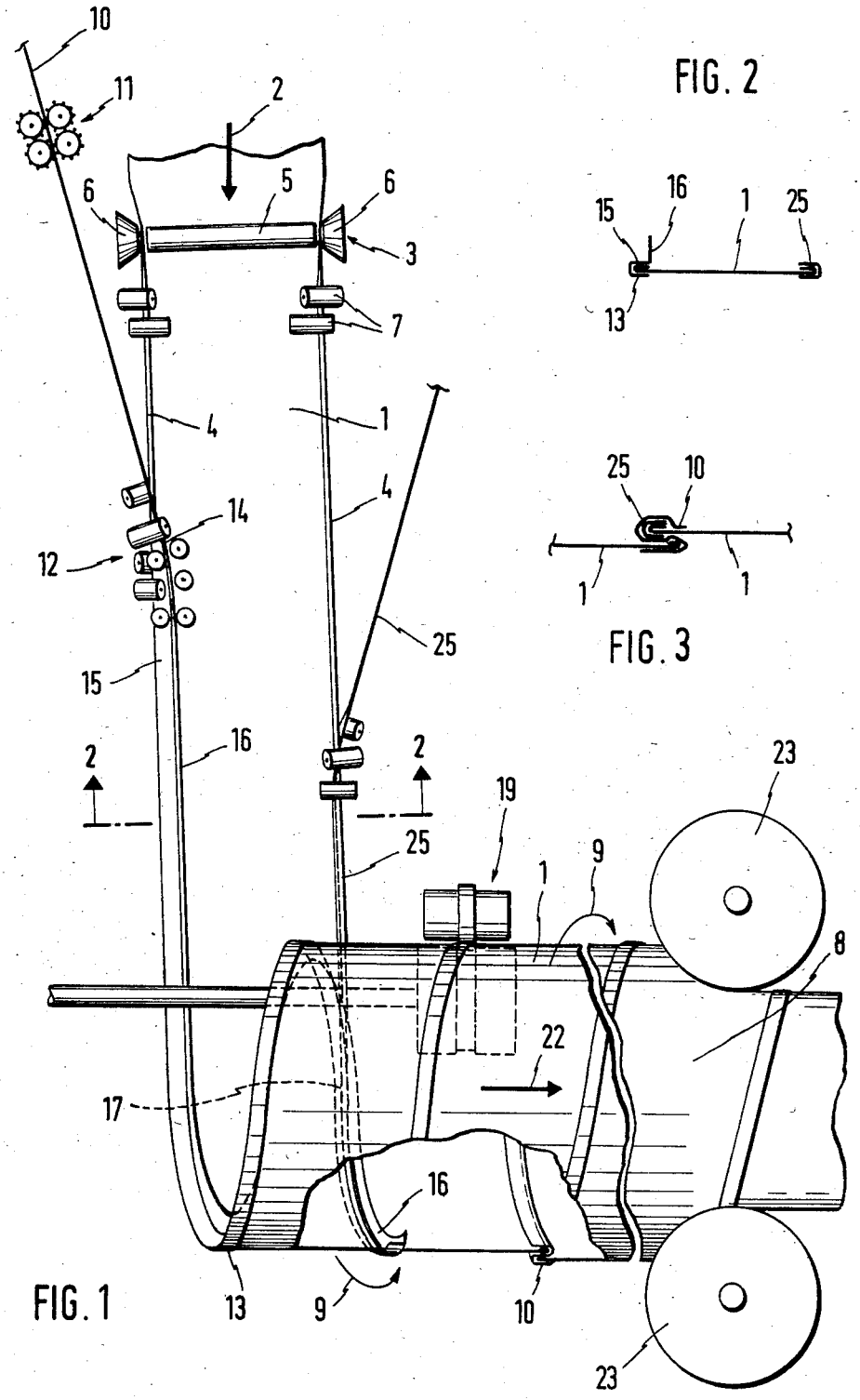
FIG. 1 is diagrammatic, perspective plane view of a piece of hose being produced from a single strip, a single connection band and a single edging tape.
FIG. 2 is a section in a plane 2—2 as marked in FIG. 1.
FIG. 3 is a diagrammatic lengthways section through the materials of the wall of a hose as produced with the apparatus of FIG. 1.

In FIG. 1 the reader will see the production of strip-wound or interlocked hose from a strip, that is to be coiled, of half-stiff metal foil, that may for example be in the form of a strip of anodized pure aluminum with a breadth of 40 mm and a thickness of 0.1 or 0.2 mm and from a connection band made of hard aluminum with a breadth of 15 mm and a thickness of 0.2 to 0.5 mm and from an edging tape in the form of a thin metal strip. Hose made only from these materials without any further materials such as adhesive tape or the like is completely non-combustible and at the same time is flexible to a certain degree inasfar as when the hose is bent the foil on the inside of a bend is folded together. However the number of folds is not very great. Such foil material with for example a diameter of 10 cm is normally not used again after being installed after producing the necessary bends. That is to say the hose is not moved for the rest of its working life.

Pure aluminum strip with a thickness of 0.1 or 0.2 mm keeps to these conditions with respect to flexibility while at the same time being of some toughness as is needed to make certain that the turns, convolutions or spirals of the hose are kept joined together. However for producing non-combustible hose it is possible for other metal foils with roughly the same stiffness and flexibility to be used.

Such a metal foil strip 1 is moved in the direction of motion 2 to a helical guide (not to be seen in full detail) of known design so that the strip 1 is guided along a round path with a certain lengthways lead, that is to say a helical line. Before the strip gets as far as the guide, edge beads 4 are formed on the strip in a beading unit 3 or station by bending round the top opposite edges of the strip. This effect is produced by the beading unit having a number of pressing rollers, of which some are freely running ones and the others are turned by power. As for details, it is to be noted that the strip 1 is moved between two guide rollers 5, of which only the upper one is to be seen, while at its edges the strip is acted on by pressing rollers 6 having coned end faces for turning up the edges, the edges then being bent round back on to the strip as an edging border by rollers 7. It is in this form that the strip 1 is joined up with a piece 8 of hose that has been produced earlier on and that is being turned as marked by arrow 9. This joining operation is undertaken with the help of a connection band 10.

After issuing from the beading unit 3, the strip 1 then, as noted, has the connection band 10 put on it, this being undertaken in the present working example of the invention in a plane normal to the plane of the strip 1, this connection band 10 running firstly through a roughening unit 11 and then in a folding unit 12 it is folded round one of the edges of the strip 1, this edge being in the present working example that edge which, on later connection of the strip 1 with the piece 8 of hose, will be the edge which is kept free for some time. The folding round operation is undertaken in the present example in such a way that about one third of the connection band is on the lower surface, while two times this breadth, that is to say about two thirds of the breadth of the connection band 10 are placed along the top surface of the metal foil strip 1, onto which the edge bead 4 was folded. The leg of the fold placed on the lower surface is numbered 13 and the fold leg on the top side is generally numbered 14. The folding unit 12 is then responsible for its part for division of the fold leg 14 into two halves 15 and 16, of which the fold leg half 16 is bent so as to be running outwards somewhat so that it may be gripped more readily in a later unit. The placing of the different pressing rollers, making up the folding unit 12, may readily be undertaken by one working in the art.

The unit 12 will be seen to be placed at a point along the length of the part of the strip 1 moving to the piece 8 of hose, although it might be placed at the free front edge of the hose itself. On the same lines, while producing generally the same function, it is possible for the unit to take effect on the opposite side of the strip 1 and/or for the breadth ratio of the fold legs 13 and 14 to be the other way round. That edge, which is opposite to the edge fitted with the connection band 10, is fitted with a guard edging tape 25, this tape is in the form of a thin foil strip that is firstly moved out in a plane normal to the supply plane of the strip 1 and is bent round the edge of the strip 1 as a more or less complete safeguard for the edge so that the edge will not be torn or frayed even if the strip is made of readily tearing metal foil.

The strip 1 is now joined up with the piece 8 of hose produced so far as the front turn thereof, this being done by the edge to be seen on the right of the strip in FIG. 1, which edge has not been folded over with the connection strip 1, being placed with a certain degree of overlap on the inside against the free edge of the last turn of the strip 1 of the piece 8 of hose. It is a question here of that edge that a certain distance further back was fold-joined to the connection strip 10, the half 16 of the fold leg running out inwards. The bend or corner between the leg halves 15 and 16 takes the form of a stop at the limit of the overlap between the strip material of the turns coming one after the other. The tangential feed into position and contact of the subsequent material of the strip 1 takes place in FIG. 1 at a position 17 that is covered up by the top wall of the hose.

It will be seen that in the connection rim running helically round the finished hose the material is placed in seven layers, because in addition to the five layers noted so far and of the two layers formed by the U-legs of the edging tape 25. Although not pictured in the present figure, it would be furthermore possible for the opposite edge to be taped or guarded with an edging tape before the connection band is put on, this being more specially the case if the connection strip is only put on in the helical part of the structure after it has been turned through a certain angle.

The turn guide (see FIG. 1) at the first turn or the first turns of the piece 8 of hose may be made up a number of separate guide parts, through which the strip material may be run, that are not to be seen in the figure and are placed in a circle for guiding the hose into its round form. The piece 8 of the hose is moved on further on a guide bed in the direction of the arrow 22 in keeping with the speed of production.

In the next unit, the ironing unit 19, the fold leg half 16 is bent round the strip edge, that has taken up a position in the angle between the fold leg halves 15 and 16, and the layer system 13-1-15-25-1-15-16 is ironed, compressed or compacted over its full area, along lines or at spaced points as may be desired. If the pressing or ironing operation takes place along a line it is possible to make certain that the edge beads 4 are not squeezed out completely flat while at the same time nevertheless having the connection band 10 pressed strongly enough against the material of the strip 1 or the edging tape 25 so as to give a strong join between each turn and the one next to it. By pressing only at spaced points, for example by using a roller with buttons or the like thereon, it is possible to have a still stronger pressing effect and bending of the material so that there is a further locking or positive keying effect.

In a case in which the folding unit 12 is placed on the edge of the strip 1 which is opposite to the edge thereof on which it is placed in FIG. 1, the folding unit 12 is so placed on the last turn of the hose that its free edge takes up a position between the fold leg halves 15 and 16 when the strip is running into the unit. This may more specially give a useful effect if the desired overlap is relatively large and for this reason the fold leg half 16 is broad, because in this case the unit 19 may be placed right at the position 17 at which the strip 1 is run onto the turning hose and furthermore with respect to the fold leg half 16, sticking out inwards or outwards, there is no trouble in getting it bent round into the desired form.

In FIG. 1 the unit 19 will be seen at a point at some distance after the point at which the overlap between turns has been produced. In fact however, in the case of a connection band 10 turning at the end of the piece of hose, this unit 19 is best placed right at the position 17 at which the strip comes onto the hose.

The piece 8 is pressed later by pressing rollers 23 (of which one or more pairs are placed with their axes in two directions at right angles to each other so as to be tangential to the piece hose) into a structure with rectangular cross section that may be used as a fire-proof flat duct as part of a ventilation system. The pressing or forming rollers 23 may furthermore take effect on the hose on a later separate operation after cutting off the hose produced from the helical guide of FIG. 1, this being for the purpose of side-stepping design troubles likely because of the turning of the hose about its own axis at the time it is being produced by coiling. If the hose produced is only pushed on some distance through the pairs of ironing rollers 23 a connection piece is produced for joining round and flat ducting.

As a further possible finishing operation on the hose so produced the hose may have a hole made in the side of it and be swaged into the side net so as to give a branch. The materials noted for the aluminum foil strips and aluminum connection band may be swaged and widened with little trouble like a homogeneous hose wall.

In FIG. 2 the reader will see one folding step on producing the hose. In a stage the strip 1 has had the edge beads 4 formed on it the connection band 10 is in the stage of being folded so that it is now possible to see the angle or corner between the fold leg halves 13 and 15; fold leg halves 15 and 16, and the edging tape 25 has been bent round the edge opposite to the one bearing the connection band.

The embodiments of the invention in which an exclusive property or privilege is claimed is as follows:

1. In a strip-wound hose made up of at least one metal foil strip placed in helical turns and of a metal connection band, each of said foil strip turns having an edge portion overlapping with an edge portion of a foil strip turn next thereto in an axial direction of said hose and furthermore overlapping said connection band, the invention residing in that said connection band is S-like in transverse section with the base of the letter S forming two pockets facing in opposite directions along the length of the hose, said edge portions being tucked from opposite sides into pockets of said connection band, said connection band having been pressed together in a radial direction with respect to the hose along lines running in the round-the-hose direction to crimp the pockets closed and firmly secure said overlapping edge portions together by said connection band, and edging tape of U-like radial cross section placed on an edge portion of said strip, said edge portion and edging tape being taken up in one of said pockets of said connection band.

2. A strip-wound hose as claimed in claim 1, manufactured by a process comprising the steps of: longitudinally feeding a foil strip, moving said strip into a helical path to form a helical hose with the turns thereof placed one after the other along a hose axis and the edges of adjacent strip turns overlapping, supplying said connection band, forming a pocket of said connection band along one edge of said strip ahead of said helical path to fix the connection band to the strip, supplying said edging tape, forming said edging tape about that edge of the strip that is opposite to the connection band fixed on the strip before the strip has started moving in a helical path, and forming said connection band about said edging tape when it has started moving in said helical path.

3. A strip-wound hose as claimed in claim 2 wherein a surface selected from: a surface of the connection band, and a surface of the edging tape, is roughened in zones in which it is to come into contact with the strip.

4. A strip-wound hose as claimed in claim 2 wherein the structure is forced together and compressed at points spaced out in the round-the-hose direction, the degree of pressing at such points being higher than pressing of the material at parts thereof between the points.

* * * * *